US005473420A

United States Patent [19]

Rizzolo et al.

[11] Patent Number: 5,473,420

[45] Date of Patent: Dec. 5, 1995

[54] SHEET STACKING AND REGISTERING DEVICE HAVE CONSTRAINED REGISTRATION BELTS

[75] Inventors: Charles D. Rizzolo; John R. Falvo, both of Rochester, N.Y.

[73] Assignee: Xerox Corporation, Stamford, Conn.

[21] Appl. No.: 278,201

[22] Filed: Jul. 21, 1994

[51] Int. Cl.[6] ..... G03G 21/00

[52] U.S. Cl. ..... 355/321; 270/58; 271/178; 271/186; 271/223; 355/324; 414/789.1

[58] Field of Search ..... 355/317, 321, 355/322, 324; 270/58; 414/789.1; 271/177, 178, 187–186, 220, 223

[56] References Cited

U.S. PATENT DOCUMENTS

| | | | |
|---|---|---|---|
| 4,605,211 | 8/1986 | Sonobe | 270/53 |
| 4,883,265 | 11/1989 | Iida et al. | 271/220 |
| 5,005,821 | 4/1991 | Burger | 271/190 |
| 5,044,625 | 9/1991 | Reid | 271/293 |
| 5,249,793 | 10/1993 | Scheufler | 271/220 |
| 5,288,062 | 2/1994 | Rizzolo et al. | 270/53 |
| 5,289,251 | 2/1994 | Mandel et al. | 355/324 |

FOREIGN PATENT DOCUMENTS

| | | |
|---|---|---|
| 0346851 | 6/1989 | European Pat. Off. . |

*Primary Examiner*—William J. Royer
*Attorney, Agent, or Firm*—Kevin R. Kepner

[57] ABSTRACT

An apparatus for stacking, registering and attaching one or multiple sets of electrophotographic printing machine output. The copy sheets are discharged from the machine and fall into an inclined compiling tray and are longitudinally registered by flexible, endless belts contacting the top surface of each sheet. The belts are restrained from deforming and walking along the top of the stack by an idler member allowing greater stack capacity in the tray. Each sheet is then laterally shifted by a tamping mechanism to laterally register the sheet. Once a complete set of sheets has been discharged and fully registered the sheets of the stack are then attached by a stapler or some other sheet fastening or binding device and the stock is discharged from the compiling tray.

24 Claims, 4 Drawing Sheets

SHEET STACKING AND REGISTERING DEVICE HAVE CONSTRAINED REGISTRATION BELTS

This invention relates generally to a finishing station of an electrophotographic printing machine, and more particularly concerns a sheet compiler used therein.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, it is often desirable to stack the discharged copy sheets, numbering from two sheets up to a large number of sheets, in sets with very close stack registration so as to avoid a ragged or uneven looking stack edge in finished, bound or stapled copy sets. It is further desirable when stapling or binding a set of sheets to locate or move the registered stack to a position at which the stapling or binding device can act upon the stack without disturbing the stack registration. It is also desirable to be able to stack and register copy sheet sets rapidly so as to not interrupt the output of the printing machine. It is also advantageous to be able to accommodate a wide range of stack heights and to be able to compile large sets or stacks of sheets. It is further advantageous to be able to compile and stack a wide range of paper sheet sizes and weights and/or stiffnesses without damage to the edges of the sheets or image smearing or other damage to the copies.

The following disclosures may be relevant to various aspects of the present invention:

- U.S. Pat. No. 5,288,062 Patentee—Rizzolo et al. Issue Date—Feb. 22, 1994
- U.S. Pat. No. 5,044,625 Patentee—Reid Issue Date—Sep. 3, 1991
- U.S. Pat. No. 5,005,821 Patentee—Burger Issue Date—Apr. 9, 1991
- U.S. Pat. No. 4,883,265 Patentee—Iida, et al. Issue Date—Nov. 28, 1989
- EP-A-0 346 851 A 1 Applicant—Masakazu Publication Date—Dec. 20, 1989
- U.S. Pat. No. 4,605,211 Patentee—Sonobe Issue Date—Aug. 12, 1986

The relevant portions of the foregoing disclosures may be briefly summarized as follows:

U.S. Pat. No. 5,288,062 describes an apparatus for stacking, registering and attaching one or multiple sets of electrophotographic printing machine output. The copy sheets are discharged from the machine and fall into an inclined compiling tray and are longitudinally registered by flexible, endless belts contacting the top surface of each sheet and then each sheet is laterally shifted by a tamping mechanism which has an upwardly flared baffle to corrugate the sheet as it is shifted to increase the sheet beam strength and facilitate easier and more complete registration. The discharge nip assembly which includes the flexible belts is vertically adjustable to maintain optimum contact by the endless registration belt and allow for high capacity compiling. The compiling tray can also be adjustable.

U.S. Pat. No. 5,044,625 discloses a lateral tamping device which utilizes a flapper arm or flag rotating about a fixed point to laterally align discharged copy sheets in various sorter bins U.S. Pat. No. 5,005,821 discloses a sheet stacking assistance and control system which comprises an endless, weighted, chain-like, loose element member. The beaded chain portion continuously lies on a top sheet of a stack and continuously drags it towards the registration position.

U.S. Pat. No. 4,883,265 discloses a stacking apparatus comprised of an endless web which is contactable to the top surface of a discharged sheet. The web, which may be an endless belt, rotates so as to displace the sheet until it abuts a registration edge or stopper disposed adjacent to the discharge outlet of the device.

EP-A-0 346 851 A 1 describes a discharge sheet stack compiler and registration device which utilizes endless belts for both end registration and as a lateral registration device. The sheets are discharged and compiled in a fixed tray and after compiling and stapling, are further discharged to a catch tray.

U.S. Pat. No. 4,605,211 describes a discharge sheet compiling tray which collects the discharged copy sheets and aligns said sheets gravitationally until the set is complete. After binding the completed set, it is then discharged from the catch tray by a rocking type motion.

In accordance with one aspect of the present invention, there is provided an apparatus for registering sheets being compiled into a stack. The apparatus comprises a drive member, a belt partially entrained around said drive member forming a selected arcuate configuration with an outer surface of said belt being adapted to contact a topmost sheet of the stack to urge the sheet into a registered position and a restraining device operatively associated with said belt to maintain said belt in the selected arcuate configuration as the sheets in the stack increase.

Pursuant to another aspect of the invention there is provided an electrophotographic printing machine having a sheet finisher for registering sheets being compiled into a stack. The sheet finisher comprises a drive member, a belt partially entrained around said drive member forming a selected arcuate configuration with an outer surface of said belt being adapted to contact a topmost sheet of the stack to urge the sheet into a registered position and a restraining device operatively associated with said belt to maintain said belt in the selected arcuate configuration as the sheets in the stack increase.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 6:
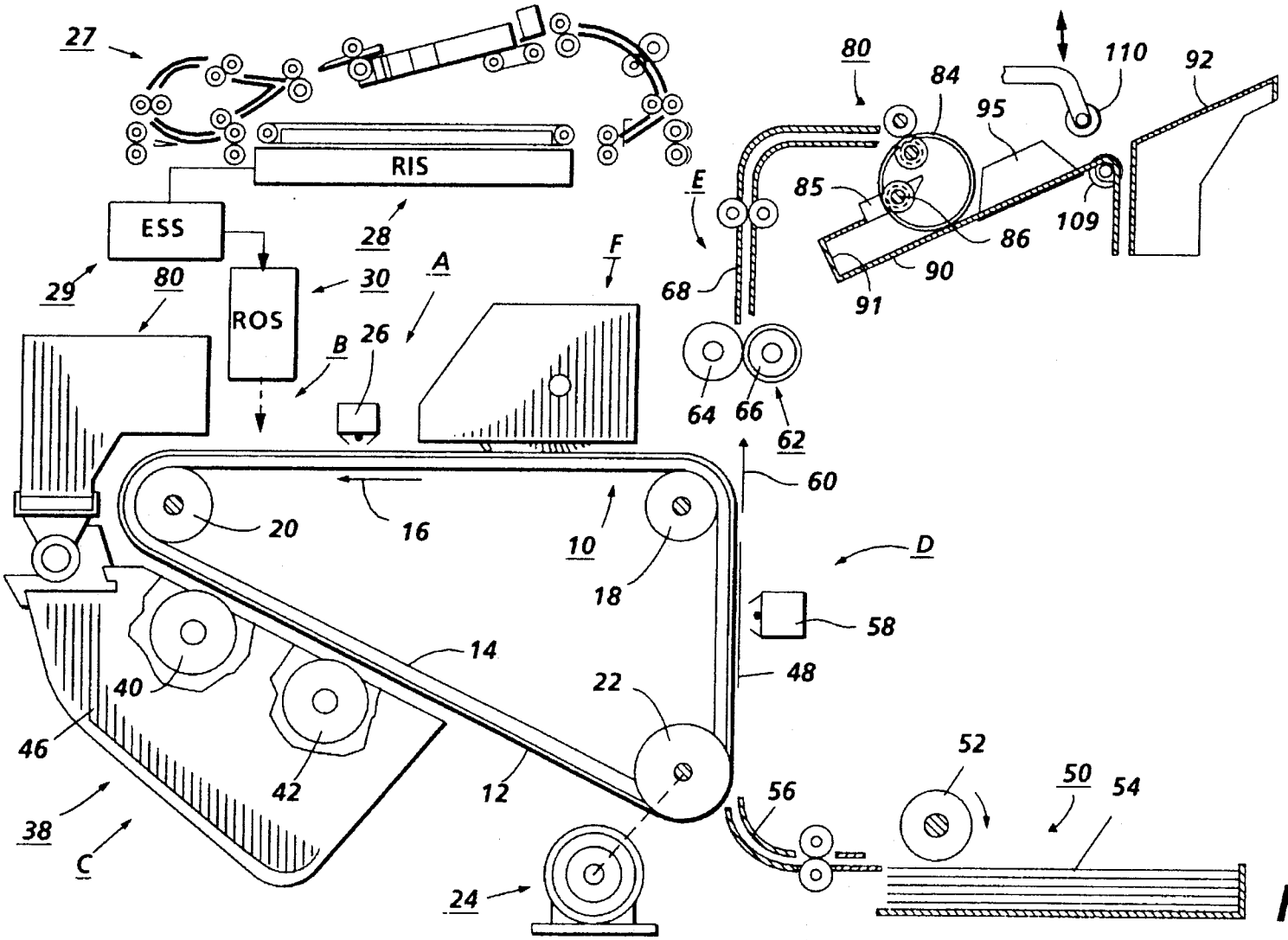
FIG. 6 is a schematic elevational view depicting an illustrative electrophotographic printing machine incorporating the sheet compiling apparatus of the present invention therein.

For a general understanding of an electrophotographic printing machine in which the features of the present invention may be incorporated, reference is first made to FIG. 6 which depicts schematically the various components thereof. Hereinafter, like reference numerals will be employed throughout to designate identical elements. Although the apparatus for compiling sheets is particularly well adapted for use in the electrophotographic printing machine of FIG. 6, it should become evident from the following discussion that it is equally well suited for use in a wide variety of machines and is not necessarily limited in this application to the particular embodiment shown herein.

Referring to FIG. 6 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

The FIG. 6 printing machine employs a belt 10 having a photoconductive surface 12 deposited on a conductive ground layer 14. Preferably, photoconductive surface 12 is made from a photoresponsive material, for example, one comprising a charge generation layer and a transport layer. Conductive layer 14 is made preferably from a thin metal layer or metallized polymer film which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges the photoconductive surface, 12, to a relatively high, substantially uniform potential. After photoconductive surface 12 of belt 10 is charged, the charged portion thereof is advanced through exposure station B.

At exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers.

The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station C, where toner, in the form of liquid or dry particles, is electrostatically attracted to the latent image using commonly known techniques. Development station C contains the space optimizing toner cartridge described in detail below. Preferably, at development station C, a magnetic brush development system, indicated by reference numeral 38, advances developer material into contact with the latent image. Magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. The toner particle dispenser, indicated generally by the reference numeral 80, dispenses toner particles into developer housing 46 of developer unit 38.

With continued reference to FIG. 6, after the electrostatic latent image is developed, the toner powder image present on belt 10 advances to transfer station D. A print sheet 48 is advanced to the transfer station, D, by a sheet feeding apparatus, 50, the stacking tray of which includes the sensors of the invention herein. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

The fusing station, E, includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting, fuser roller 64. In this manner, the toner powder image is permanently affixed to sheet 48. After fusing, sheet 48 advances through chute 68 to the discharge roller pairs 82, 83, to the compiling apparatus of the present invention generally indicated by the reference numeral 80.

The compiling apparatus 80 includes generally, a sheet discharge device, usually in the form of a drive nip assembly, which includes the exit drive rolls 82, 83 and the longitudinal registration belts 84; a compiling tray 90; a compiled set discharge device 109, 110; and a stacking tray 92 for receipt of the finished attached sheet sets 49. Compiling apparatus 80 will be described hereinafter in greater detail with reference to FIG. 1 through FIG. 5, inclusive.

After the print sheet is separated from photoconductive surface 12 of belt 10, the residual toner/developer and paper fiber particles adhering to photoconductive surface 12 are removed therefrom at cleaning station F. Cleaning station F includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for the purposes of the present application to illustrate the general operation of an electrophotographic printing machine. Referring now to the specific subject matter of the present invention, FIGS. 1–5 depict the sheet compiling apparatus and the improvements provided by the invention herein in greater detail.

Figure 1:
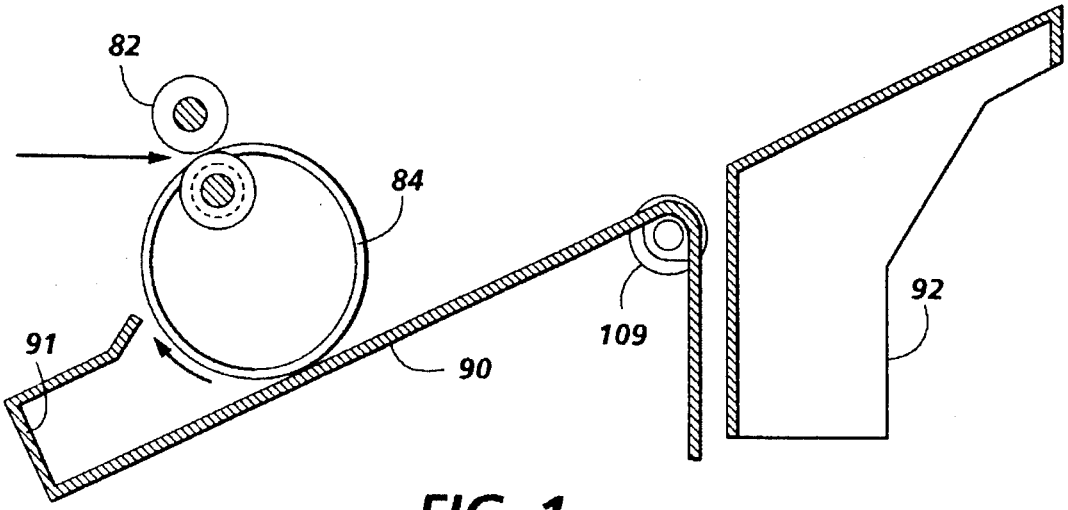
FIG. 1 PRIOR ART
FIGS. 1 and 2 are elevational views of a known flexible belt sheet compiling device.
Figure 2:
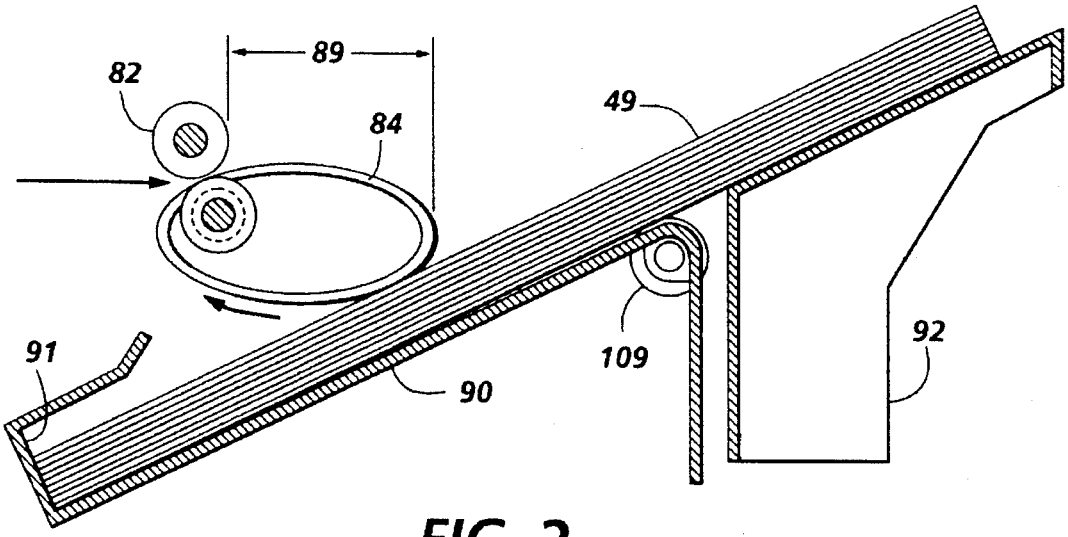
FIG. 2 PRIOR ART

Turning now to FIGS. 1 and 2, there is illustrated a flexible belt compiling tray of the type not having the restraining member of the present invention. The sheets are discharged from a printing machine through the nip formed between the discharge rollers 82 and 83 and into the compiling tray 90. The sheet travels around the outside of the longitudinal registration belt 84 and is registered against the back wall 91 of the tray 90 by the friction of the belt 84 on top of the stack. As the sheet stack 49 builds in height, the longitudinal registration belt 84 is deformed into an elliptical shape (see FIG. 2). This deformation of the longitudinal registration belt 84 increases the distance, represented by arrow 89, that a sheet has to travel out of the nip 81 and then back toward the registration wall 91. This increased distance and extra scuffing force decreases the reliability of the compiler and also limits the number of sheets which may be accurately registered and compiled. Some other approaches to solve this problem have been to make the compiling tray movable in the vertical direction so as to maintain a relatively stable belt profile and/or to cause the discharge nip to move in a vertical direction relative to the tray for the same purpose. These approaches, while achieving the desired function, add to the complexity and cost of the machine and are not practical for many applications.

Figure 3:
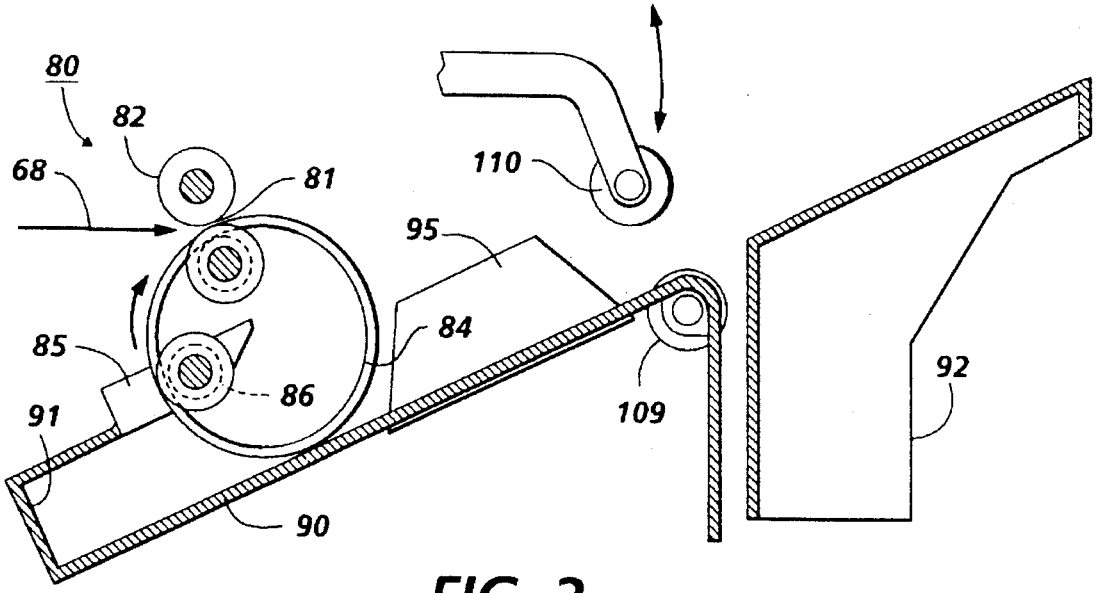
FIGS. 3 and 4 are elevational views of the high capacity flexible belt compiler of the present invention.
Figure 4:
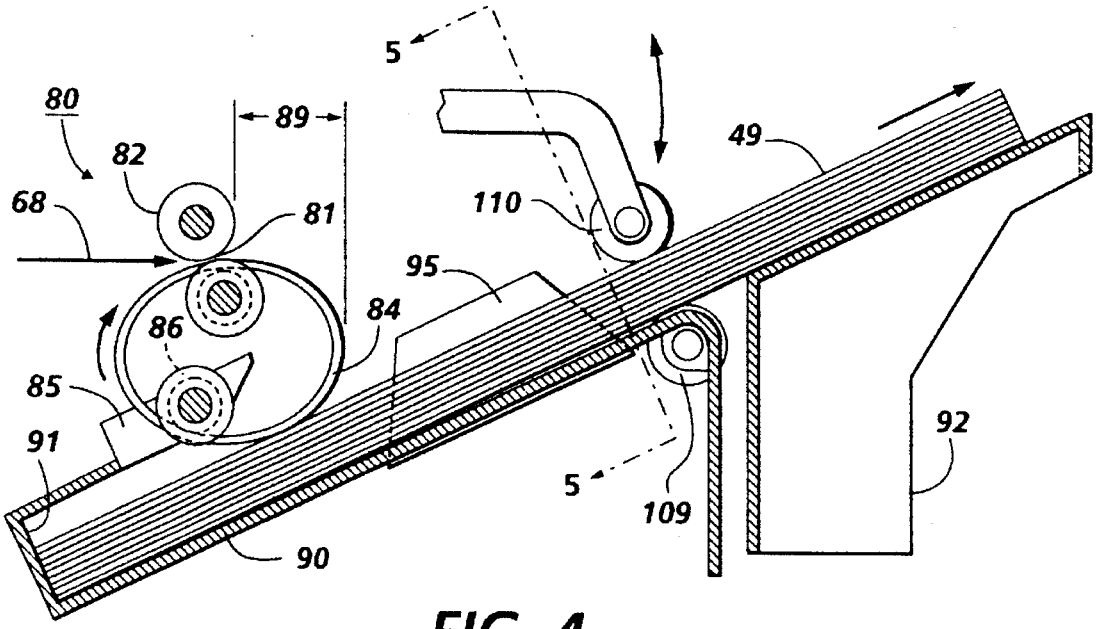

Turning next to FIGS. 3 and 4, the same type belt compiler is shown utilizing the restraining member 86 of the present invention. As in the previously described instance, the sheet 48 is discharged through the chute 68 and through the nip 81 formed between the discharge rolls 82 and 83 where it falls along the outside of the flexible longitudinal registration belt 84 and is driven by the belt 84 back against the registration wall 91 of the tray 90. As the sheet stack 49 builds, the restraining member 86 prevents the belt 84 from walking away from the registration wall 91 along the top of the stack 49 into a severe elliptical shape and maintains a relatively stable belt profile. This restrained belt profile minimizes longitudinal distortion of the belt and allows the stack to build to a greater height and maintain the accuracy of registration. Increased belt stability is also an added benefit of using the restraining member. The restraining member is easily mounted to the curl guard 85 which also assists in the registration of the sheets by preventing any curled up edges of the sheets from stubbing prior to registering against the registration wall 91.

Once the compiled stack 49 is into the tray 90, it may be attached by means of a stapler, binder, stitcher, or other attaching device into a completed attached set. The completed attached set can then be driven out of the tray 90 by set ejector driver rolls 109, 110 which come together to clamp the compiled set and move it onto the stacking tray 92. Of course other set discharge devices such as clamps, pushers, grabbers etc. could also be utilized to eject the set from the compiling tray.

Figure 5:
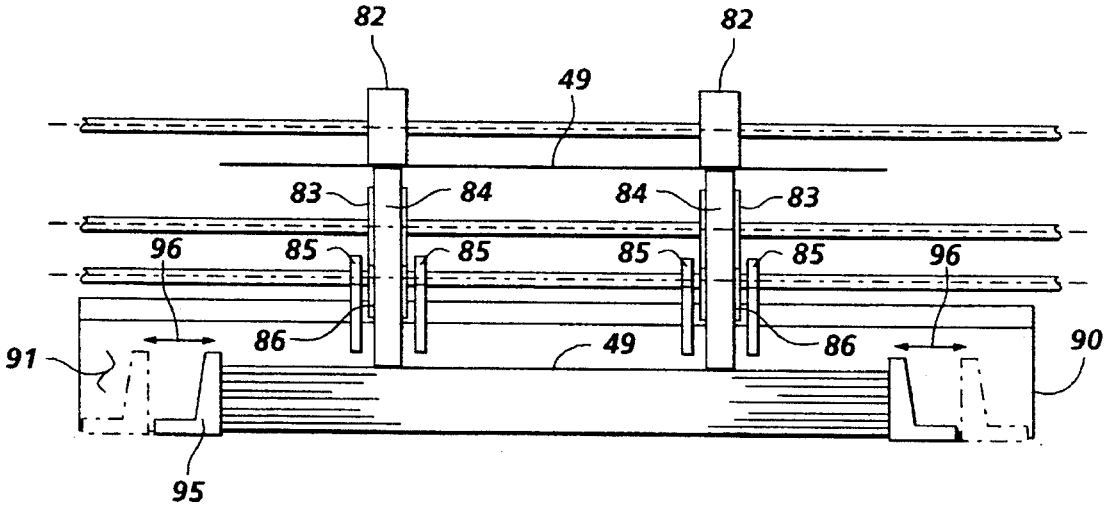
FIG. 5 is an end view taken along the line in the direction of arrows 5—5 in FIG. 4.

Turning next to FIG. 5 which is an end view of the compiler tray of FIGS. 3 and 4, it can be seen that a pair of side tampers 95 can be utilized to maintain lateral registration within the tray. As illustrated, the pair of tampers 95 are utilized in a center registered type machine. As each sheet 48 is discharged into the tray 90 and registered by the belt 84 against the back wall 91 of tray 90, the tamper members 95 move toward each other as indicated by arrows 96 to the width of the sheets and align the sheets laterally. As each sheet is discharged, the tamper members 95 are actuated, thereby maintaining laterial registration in conjunction with the longitudinal registration performed by belts 84. Obviously, a single tamper member and a fixed side registration wall could be utilized for a side registered type device.

In recapitulation, there is provided an apparatus for stacking, registering and attaching one or multiple sets of electrophotographic printing machine output. The copy sheets are discharged from the machine into an inclined compiling tray and are longitudinally registered by flexible, endless belts contacting the top surface of each sheet. Each sheet is then laterally shifted by a tamping mechanism to register the sheet. Once a complete set of sheets has been discharged and fully registered, the stack is then attached by stapling or other means and is discharged from the compiling tray.

It is, therefore, apparent that there has been provided in accordance with the present invention, a high capacity flexible belt sheet compiler that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for registering sheets being compiled into a stack, comprising:

a drive member;

a belt partially entrained around said drive member forming a selected arcuate configuration with an outer surface of said belt being adapted to contact a topmost sheet of the stack to urge the sheet into a registered position; and a restraining device operatively associated with said belt to maintain said belt in the selected arcuate configuration as the sheets in the stack increase.

2. An apparatus according to claim 1, wherein said drive member comprises a rotatably supported, driven roll about which said belt is partially entrained.

3. An apparatus according to claim 1, further comprising a sheet compiling tray disposed adjacent to said belt for receiving sheets to be compiled into the stack.

4. An apparatus according to claim 3, further comprising a rotatable idler member adjacent said drive member so as to form a sheet discharge nip therewith.

5. An apparatus according to claim 4, wherein said sheet compiling tray further comprises an end registration edge adjacent to the discharge nip.

6. An apparatus according to claim 3, further comprising means for ejecting a compiled sheet stack from said sheet compiling tray.

7. An apparatus according to claim 3, further comprising a lateral registration device to align laterally each of the received sheets in said compiling tray.

8. An apparatus according to claim 3, further comprising means disposed adjacent to said sheet compiling tray, for attaching the sheets of the stack to one another.

9. An apparatus according to claim 1, further comprising a guide disposed parallel to said belt at a height not lower than that of the lower outer surface of said belt.

10. An apparatus according to claim 9, wherein said restraining device is rotatably mounted on said guide.

11. An apparatus according to claim 1, further comprising a registration member adjacent said belt against which the sheets are urged into position.

12. An apparatus according to claim 1, wherein said restraining device comprises a rotatable member in contact with an inner surface of said belt to restrain said belt from deforming by walking along the top of the stack.

13. An electrophotographic printing machine having a sheet finisher for registering sheets being compiled into a stack, comprising:

a drive member;

a belt partially entrained around said drive member forming a selected arcuate configuration with an outer surface of said belt being adapted to contact a topmost sheet of the stack to urge the sheet into a registered position; and a restraining device operatively associated with said belt to maintain said belt in the selected arcuate configuration as the sheets in the stack increase.

14. A printing machine according to claim 13, wherein said drive member comprises a rotatably supported, driven roll about which said belt is partially entrained.

15. A printing machine according to claim 13, further comprising a sheet compiling tray disposed adjacent to said belt for receiving sheets to be compiled into the stack.

16. A printing machine according to claim 15, further comprising a rotatable idler member adjacent said drive member so as to form a sheet discharge nip therewith.

17. A printing machine according to claim 16, wherein said sheet compiling tray further comprises an end registration edge adjacent to said discharge nip.

18. A printing machine according to claim 15, further comprising means for ejecting a compiled sheet stack from said sheet compiling tray.

19. A printing machine according to claim 15, further comprising a lateral registration device to align laterally each of the received sheets in said compiling tray.

20. A printing machine according to claim 15, further comprising means disposed adjacent to said sheet compiling tray, for attaching the sheets of the stack to one another.

21. A printing machine according to claim 13, further comprising a guide disposed parallel to said belt at a height not lower than that of the lower outer surface of said belt.

22. A printing machine according to claim 21, wherein said restraining device is rotatably mounted on said guide.

23. A printing machine according to claim 13, further comprising a registration member adjacent said belt against which the sheets are urged into position.

24. A printing machine according to claim 13, wherein said restraining device comprises a rotatable member in contact with an inner surface of said belt to restrain said belt from deforming by walking along the top of the stack.

* * * * *